US010777144B2

(12) United States Patent
Seo et al.

(10) Patent No.: US 10,777,144 B2
(45) Date of Patent: Sep. 15, 2020

(54) METHOD OF OPERATING DISPLAY PANEL AND DISPLAY APPARATUS PERFORMING THE SAME

(71) Applicant: SAMSUNG DISPLAY CO., LTD., Yongin-si, Gyeonggi-do (KR)

(72) Inventors: Jung-Deok Seo, Cheonan-si (KR); Yoon-gu Kim, Seoul (KR); Bong-Im Park, Hwaseong-si (KR); Byung-Kook Sim, Hwaseong-si (KR); Hyun-sik Hwang, Hwaseong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 655 days.

(21) Appl. No.: 15/079,955

(22) Filed: Mar. 24, 2016

(65) Prior Publication Data

US 2017/0092201 A1 Mar. 30, 2017

(30) Foreign Application Priority Data

Sep. 25, 2015 (KR) ..... 10-2015-0136727

(51) Int. Cl.

*G09G 3/3291* (2016.01)
*G09G 3/20* (2006.01)
*G09G 3/36* (2006.01)

(52) U.S. Cl.

CPC ..... *G09G 3/3291* (2013.01); *G09G 3/20* (2013.01); *G09G 3/3685* (2013.01); *G09G 2310/0235* (2013.01); *G09G 2310/0272* (2013.01); *G09G 2310/0275* (2013.01); *G09G 2320/04* (2013.01); *G09G 2320/06* (2013.01)

(58) Field of Classification Search

CPC ..... G09G 2300/0426; G09G 3/3275; G09G 3/3685; G09G 2310/0272; G09G 3/3291; G09G 2310/0275; G09G 3/20

See application file for complete search history.

(56) References Cited

U.S. PATENT DOCUMENTS

2006/0158202 A1* 7/2006 Umeda ..... G06K 9/0002 324/686
2007/0103390 A1* 5/2007 Park ..... G09G 3/2022 345/60
2007/0262944 A1* 11/2007 Chen ..... G09G 3/3685 345/98

FOREIGN PATENT DOCUMENTS

KR 1020130116700 10/2013
KR 1020150010844 1/2015
KR 1020160053333 5/2016

* cited by examiner

*Primary Examiner* — William Boddie
*Assistant Examiner* — Alecia D English
(74) *Attorney, Agent, or Firm* — F. Chau & Associates, LLC

(57) ABSTRACT

In a method of operating a display panel, a plurality of data lines are divided into a first data line group through an N-th data line group, where N is a natural number equal to or greater than two. Each of the first through N-th data line groups includes at least two data lines. The first through N-th data line groups are sequentially driven by applying first data voltages through N-th data voltages to the first through N-th data line groups, respectively at different times. A first number of data lines in the first data line group is variable.

13 Claims, 15 Drawing Sheets

FIG. 15

| | DG1 | DG2 | ··· | DGN |
|---|---|---|---|---|
| CASEA | D1~D12 | D13~D24 | ··· | D949~D960 |
| CASEB | D1~D11 | D12~D23 | ··· | D948~D960 |
| CASEC | D1~D13 | D14~D25 | ··· | D950~D960 |
| CASED | D1~D10 | D11~D22 | ··· | D947~D960 |
| CASEE | D1~D14 | D15~D26 | ··· | D951~D960 |

METHOD OF OPERATING DISPLAY PANEL AND DISPLAY APPARATUS PERFORMING THE SAME

CROSS-REFERENCE TO RELATED APPLICATION

This application claims priority under 35 USC § 119 to Korean Patent Application No. 10-2015-0136727, filed on Sep. 25, 2015 in the Korean Intellectual Property Office (KIPO), the disclosure of which are incorporated by reference in their entirety herein.

BACKGROUND

1. Technical Field

Exemplary embodiments of the inventive concept relate generally to display apparatuses, and more particularly to methods of operating display panels and display apparatuses performing the methods.

2. Discussion of Related Art

A liquid crystal display apparatus is a type of flat panel display (FPD), which is widely used. The FPD may include a liquid crystal display (LCD), a plasma display panel (PDP) and an organic light emitting display (OLED), for example.

An FPD includes a display panel and a data driver. The data driver applies a plurality of data voltages corresponding to image data to a plurality of pixels in the display panel. A time duration to charge each pixel based on each data voltage may change depending on a position of each pixel in the display panel and a driving scheme for the display panel. A difference of luminance between pixels may occur in a horizontal direction or a vertical direction due to the change of the charging time, and thus a horizontal spot line or a vertical spot line may appear on the display panel.

SUMMARY

According to an exemplary embodiment of the inventive concept, in a method of operating a display panel, a plurality of data lines are divided into a first data line group through an N-th data line group, where N is a natural number equal to or greater than two. Each of the first through N-th data line groups includes at least two data lines. The first through N-th data line groups are sequentially driven by applying first data voltages through N-th data voltages to the first through N-th data line groups at different times. A first number of data lines in the first data line group is variable.

In an exemplary embodiment, when the first number is changed, a second number of data lines in the N-th data line group is changed.

In an exemplary embodiment, when the first number and the second number are changed, a third number of data lines in each of data line groups other than the first and N-th data line groups is maintained.

In an exemplary embodiment, the first number is changed for each frame duration.

In an exemplary embodiment, in dividing the plurality of data lines into the first through N-th data line groups, during a first frame duration, all of the first number, a second number of data lines in the N-th data line group, and a third number of data lines in each of data line groups other than the first and N-th data line groups is set to X, where X is a natural number equal to or greater than two. During a second frame duration subsequent to the first frame duration, the first number may be changed from X to one of (X+Y) and (X−Y), where Y is a natural number greater than 0.

In an exemplary embodiment, when the first number is changed from X to (X+Y), the second number is changed from X to (X−Y) during the second frame duration. When the first number is changed from X to (X−Y), the second number may be changed from X to (X+Y) during the second frame duration.

In an exemplary embodiment, in dividing the plurality of data lines into the first through N-th data line groups, during a third frame duration subsequent to the second frame duration, the first number is changed from one of (X+Y) and (X−Y) to X. During a fourth frame duration subsequent to the third frame duration, the first number may be changed from X to other of (X+Y) and (X−Y).

In an exemplary embodiment, Y is variable.

In an exemplary embodiment, the first number is changed for each horizontal line duration.

In an exemplary embodiment, in dividing the plurality of data lines into the first through N-th data line groups, during a first horizontal line duration of a first frame duration, all of the first number, a second number of data lines in the N-th data line group, and a third number of data lines in each of data line groups other than the first and N-th data line groups are set to X, where X is a natural number equal to or greater than two. During a second horizontal line duration of the first frame duration subsequent to the first horizontal line duration of the first frame duration, the first number may be changed from X to one of (X+Y) and (X−Y), where Y is a natural number.

In an exemplary embodiment, in dividing the plurality of data lines into the first through N-th data line groups, during a first horizontal line duration of a second frame duration, the first number is set as one of (X+Y) and (X−Y), the second frame duration being subsequent to the first frame duration. During a second horizontal line duration of the second frame duration subsequent to the first horizontal line duration of the second frame duration, the first number may be changed from one of (X+Y) and (X−Y) to X.

In an exemplary embodiment, in sequentially driving the first through N-th data line groups, the first data voltages are applied to the first data line group at a first time, second data voltages are applied to a second data line group at a second time at which one unit interval has elapsed from the first time, and the N-th data voltages are applied to the N-th data line group at an N-th time at which (N−1) unit intervals have elapsed from the first time.

According to exemplary embodiment of the inventive concept, a display apparatus includes a display panel and a data driver. The display panel includes a plurality of data lines. The data driver divides the plurality of data lines into a first data line group through an N-th data line group, where N is a natural number equal to or greater than two, generates first data voltages through N-th data voltages based on output image data, and sequentially drives the first through N-th data line groups by applying the first data voltages through the N-th data voltages to the first through N-th data line groups, respectively at different times. Each of the first through N-th data line groups includes at least two data lines. A first number of data lines in the first data line group is variable.

In an exemplary embodiment, when the first number is changed, a second number of data lines in the N-th data line group is changed.

In an exemplary embodiment, when the first number and the second number are changed, a third number of data lines in each of data line groups other than the first and N-th data line groups is maintained.

In an exemplary embodiment, the first number is changed for each frame duration. The data driver may set the first number to X during a first frame duration, where X is a natural number equal to or greater than two, and may change the first number from X to one of (X+Y) and (X−Y) during a second frame duration subsequent to the first frame duration, where Y is a natural number greater than 0.

In an exemplary embodiment, when Y is one, the data driver includes a first buffer and a second buffer. The first buffer may be connected to a first data line through an X-th data line. The second buffer may be connected to an (X+1)-th data line.

In an exemplary embodiment, when Y is one, the data driver may include a first buffer and a second buffer. The first buffer may be connected to a first data line through an (X−1)-th data line. The second buffer may be connected to an X-th data line.

In an exemplary embodiment, when Y is one, the data driver may include a first buffer, a second buffer and a third buffer. The first buffer may be connected to a first data line through an (X−1)-th data line. The second buffer may be connected to an X-th data line. The third buffer may be connected to an (X+1)-th data line.

In an exemplary embodiment, the first number may be changed for each horizontal line duration. The data driver may set the first number to X during a first horizontal line duration of a first frame duration, where X is a natural number equal to or greater than two, and may change the first number from X to one of (X+Y) and (X−Y) during a second horizontal line duration of the first frame duration subsequent to the first horizontal line duration of the first frame duration, where Y is a natural number greater than 0.

According to an exemplary embodiment of the inventive concept, a display apparatus includes a display panel including a plurality of data lines and a data driver. The data driver is configured to sequentially output data voltages to each of first data line groups, respectively, during a first period, and sequentially output data voltages to each of second data line groups, respectively, during a second period after the first period, where each data line group includes at least two of the data lines. Each of the first data line groups includes a first number of data lines, where a first group of the second data line groups includes a second number of data lines. A last group of the second data line groups include a third number of data lines. Each of the remaining groups of the second data line groups includes the first number of data lines. The second number is one of a i) a sum of the first number and a value greater than zero and a ii) difference of the first number and the value, and the third number is set to the other of the sum and the difference.

In an exemplary embodiment, the data driver is configured to sequentially output data voltages to each of the first data line groups, respectively, during a third period after the second period. In an exemplary embodiment, the second number is set to the sum during the second period, the second number is set to the difference, the third number is set to the sum, and then the data driver sequentially outputs data voltages to each of the second data line groups during a fourth period after the third period. In an exemplary embodiment, the second number is set to the difference during the second period, the second number is set to the sum, the third number is set to the difference, and then the data driver sequentially outputs data voltages to each of the second data line groups during a fourth period after the third period.

In the method of operating the display panel according to an exemplary embodiment of the inventive concept, the data lines is divided into the plurality of data line groups, and the data voltages is sequentially applied to the data line groups, respectively at different times. Thus, a time duration to charge the plurality of pixels in the display panel may be compensated. In addition, the number of data lines in at least one data line group may be changed for each frame duration and/or each horizontal line duration. Accordingly, a horizontal spot line or a vertical spot line on the display panel may be prevented.

BRIEF DESCRIPTION OF THE DRAWINGS

Exemplary embodiments of the inventive concept will be more clearly understood from the following detailed description when taken in conjunction with the accompanying drawings.

FIG. 15 is a table illustrating an example of grouping data lines based on a method of operating the display panel according to an exemplary embodiment of the inventive concept.

DETAILED DESCRIPTION OF THE EXEMPLARY EMBODIMENTS

Figure 1:
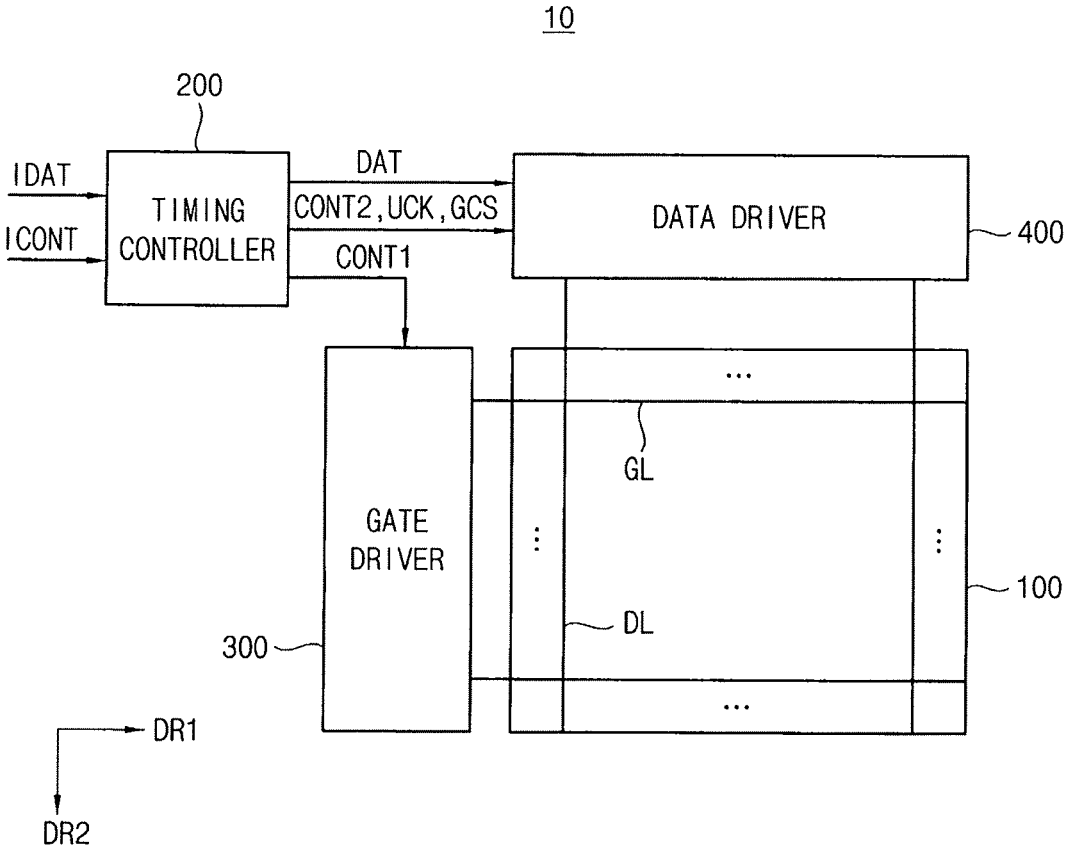
FIG. 1 is a block diagram illustrating a display apparatus according to exemplary embodiment of the inventive concept.

The inventive concept will be described more fully with reference to the accompanying drawings, in which exemplary embodiments thereof are shown. This inventive concept may, however, be embodied in many different forms and should not be construed as limited to the embodiments set forth herein. Like reference numerals refer to like elements throughout this application.

FIG. 1 is a block diagram illustrating a display apparatus according to an exemplary embodiment of the inventive concept.

Referring to FIG. 1, a display apparatus 10 includes a display panel 100, a timing controller 200, a gate driver 300 (e.g., a gate driving circuit) and a data driver 400 (e.g., a data driving circuit).

The display panel 100 operates (e.g., displays an image) based on output image data DAT. The display panel 100 is connected to a plurality of gate lines GL and a plurality of data lines DL. The gate lines GL may extend in a first direction DR1, and the data lines DL may extend in a second direction DR2 crossing (e.g., substantially perpendicular to) the first direction DR1. The display panel 100 may include a plurality of pixels (not illustrated) that are arranged in a matrix form. Each pixel may be electrically connected to a respective one of the gate lines GL and a respective one of the data lines DL.

The timing controller 200 controls an operation of the display panel 100 and controls operations of the gate driver 300 and the data driver 400. The timing controller 200 receives input image data IDAT and an input control signal ICONT from an external device (e.g., a host or a graphic processor). The input image data IDAT may include a plurality of pixel data for the plurality of pixels. The input control signal ICONT may include a master clock signal, a data enable signal, a vertical synchronization signal, a horizontal synchronization signal, etc.

The timing controller 200 generates the output image data DAT based on the input image data IDAT. The timing controller 200 generates a first control signal CONT1 based on the input control signal ICONT. The first control signal CONT1 may be provided to the gate driver 300, and a driving timing of the gate driver 300 may be controlled based on the first control signal CONT1. The first control signal CONT1 may include a vertical start signal and a gate clock signal. The timing controller 200 generates a second control signal CONT2, a shift clock signal UCK and a grouping control signal GCS based on the input control signal ICONT. The second control signal CONT2, the shift clock signal UCK and the grouping control signal GCS may be provided to the data driver 400, and a driving timing of the data driver 400 may be controlled based on the second control signal CONT2, the shift clock signal UCK and the grouping control signal GCS. The second control signal CONT2 may include a horizontal start signal, a data clock signal, a data load signal, and a polarity control signal.

The gate driver 300 generates a plurality of gate signals for driving the gate lines GL based on the first control signal CONT1. The gate driver 300 may sequentially apply the gate signals to the gate lines GL. For example, the gate driver 300 may include a plurality of shift registers (not illustrated).

The data driver 400 generates a plurality of analog data voltages based on the second control signal CONT2, the shift clock signal UCK, the grouping control signal GCS and the digital output image data DAT. The data driver 400 may sequentially apply the data voltages to the data lines DL.

In some exemplary embodiments, the gate driver 300 and/or the data driver 400 may be disposed, e.g., directly mounted, on the display panel 100, or may be connected to the display panel 100 in a tape carrier package (TCP) type. Alternatively, the gate driver 300 and/or the data driver 400 may be integrated on the display panel 100.

Figure 2:
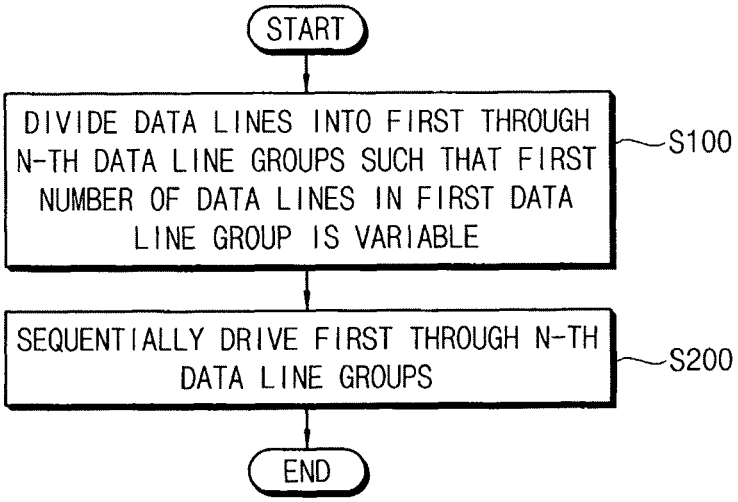
FIG. 2 is a flow chart illustrating a method of operating a display panel according to an exemplary embodiment of the inventive concept.

FIG. 2 is a flow chart illustrating a method of operating a display panel according to an exemplary embodiment of the inventive concept.

Referring to FIGS. 1 and 2, in the method of operating the display panel 100 according to an exemplary embodiment of the inventive concept, the plurality of data lines DL are divided into a first data line group through an N-th data line group based on the grouping control signal GCS, where N is a natural number equal to or greater than two (step S100). Each of the first through N-th data line groups includes at least two data lines. For example, the first data line group may include data lines that are adjacent to a first side (e.g., a left side) of the display panel 100. The N-th data line group may include data lines that are adjacent to a second side (e.g., a right side) of the display panel 100. The second side of the display panel 100 may be opposite to the first side of the display panel 100.

The first through N-th data line groups are sequentially driven based on the shift clock signal UCK (step S200). The plurality of data voltages that are generated based on the output image data DAT may include first data voltages through N-th data voltages. Each of the first data voltages through the N-th data voltages may correspond to a respective one of the first through N-th data line groups. For example, the first data voltages may correspond to the first data line group, and the N-th data voltages may correspond to the N-th data line group. The first through N-th data line groups are sequentially driven by applying the first data voltages through the N-th data voltages to the first through N-th data line groups at different times.

In the method of operating the display panel 100 according to an exemplary embodiment of the inventive concept, a first number of the data lines in the first data line group is variable. The display panel 100 may have a relatively improved display quality by adjusting the first number.

In some exemplary embodiments, the first number may be changed for each horizontal line duration and/or each frame duration. In other words, the grouping of the data lines DL in step S100 may be performed for each horizontal line duration and/or each frame duration. For example, the display panel 100 may include first through K-th horizontal lines each of which corresponds to a single pixel row, where K is a natural number equal to or greater than two. Each horizontal line in the display panel 100 may display one horizontal line image during one horizontal line duration. The display panel 100 may display one frame image during one frame duration based on first through K-th horizontal line images displayed on the first through K-th horizontal lines. The display panel 100 may display a dynamic image (e.g., a moving image, a video, etc.) or a static image (e.g., a still image, a stopped image, a photograph, etc.) based on a plurality of frame images. Step S100 may be performed at the beginning of each horizontal line duration and/or at the beginning of each frame duration.

In some exemplary embodiments, the driving of the data line groups in step S200 may be performed for each horizontal line duration. For example, step S200 may be performed for displaying one horizontal line image. In an example of performing step S100 for each horizontal line duration, steps S100 and S200 may be performed for the first horizontal line to display the first horizontal line image, steps S100 and S200 may be performed for a second horizontal line to display a second horizontal line image, and steps S100 and S200 may be performed for the K-th horizontal line to display the K-th horizontal line image. In an example of performing step S100 for each frame duration, step S100 may be performed before the first horizontal line image is displayed, and step S200 may be sequentially performed for the first through K-th horizontal lines to sequentially display the first through K-th horizontal line images.

The method of operating the display panel 100 according to exemplary embodiments may be performed by the display apparatus 10. For example, steps S100 and S200 may be performed by the data driver 400 in the display apparatus 10.

Figure 3:
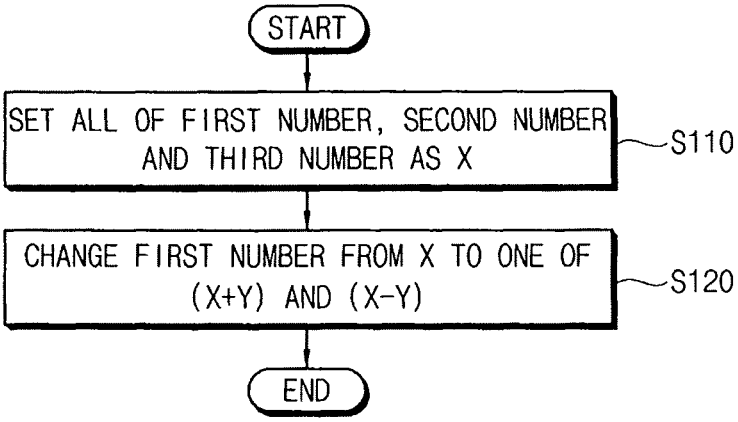
FIG. 3 is a flow chart illustrating an example of step S100 in FIG. 2 according to an exemplary embodiment of the inventive concept.
Figure 4:
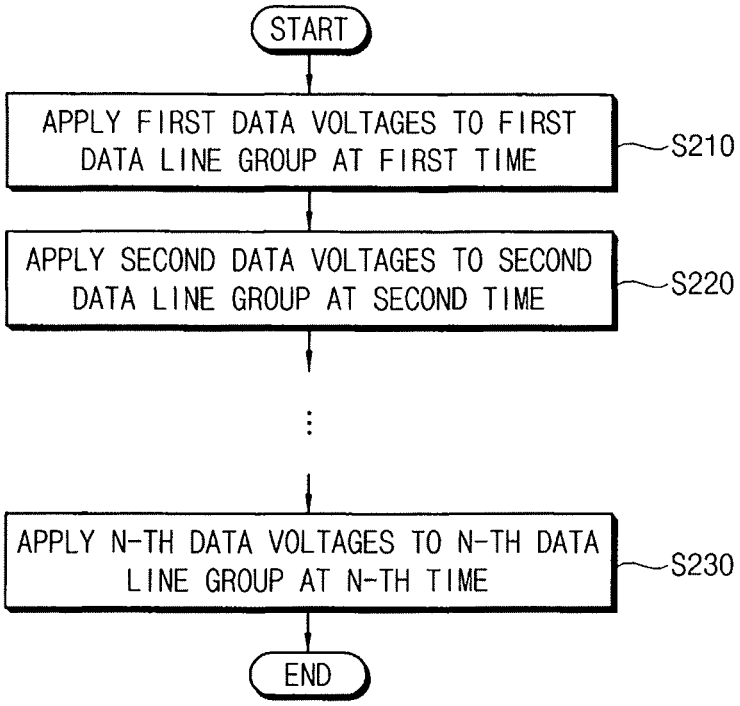
FIG. 4 is a flow chart illustrating an example of step S200 in FIG. 2 according to an exemplary embodiment of the inventive concept.
Figure 5A:
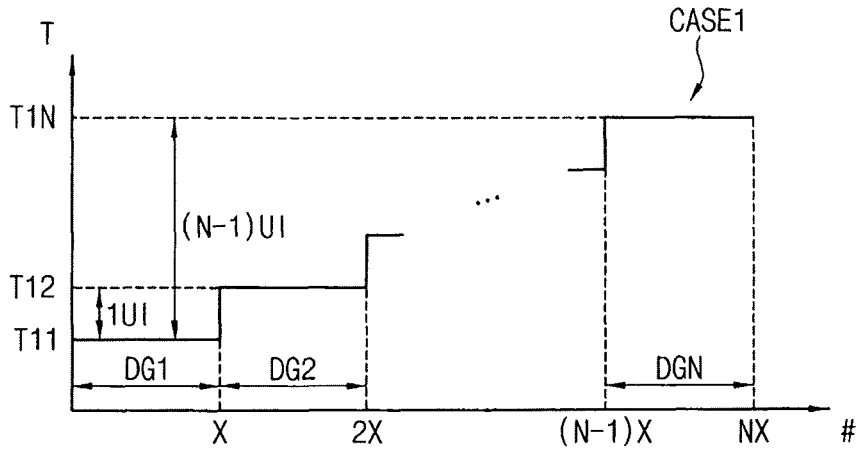
FIGS. 5A, 5B and 5C are diagrams for describing the method of operating the display panel according to exemplary embodiments of the inventive concept.
Figure 5B:
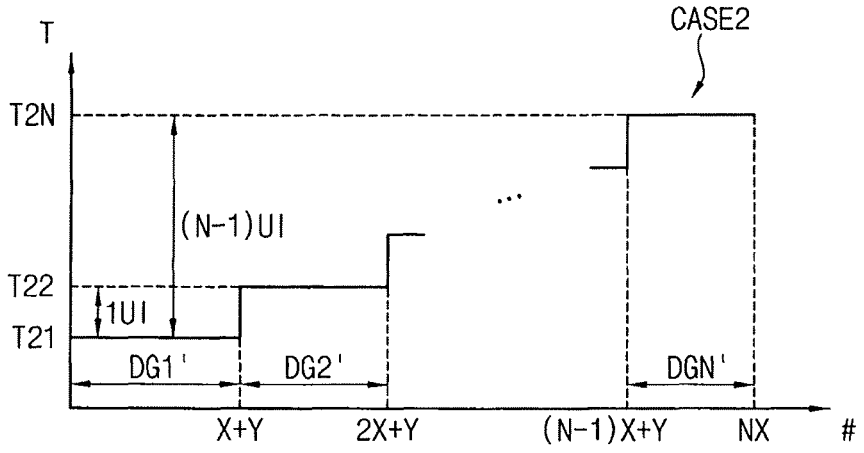
Figure 5C:
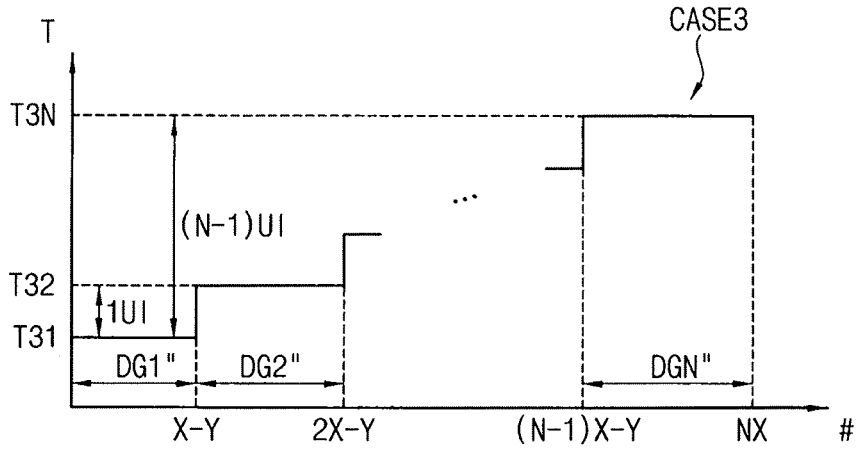

FIG. 3 is a flow chart illustrating an example of step S100 in FIG. 2 according to an exemplary embodiment of the inventive concept. FIG. 4 is a flow chart illustrating an example of step S200 in FIG. 2 according to an exemplary embodiment of the inventive concept. FIGS. 5A, 5B and 5C are diagrams for describing the method of operating the display panel according to exemplary embodiments of the inventive concept. In FIGS. 5A, 5B and 5C, a horizontal axis # represents the number of data lines, and a vertical axis T represents a time to apply data voltages to the data lines.

Referring to FIGS. 1, 3, 5A, 5B and 5C, in step S100, all of the first number of the data lines in the first data line group, a second number of data lines in the N-th data line group, and a third number of data lines in each of data line groups other than the first and N-th data line groups are set to X data lines based on the grouping control signal GCS, where X is a natural number equal to or greater than two (step S110). The grouping of the data lines DL in step S110 may be referred to as a first grouping.

For example, as illustrated in FIG. 5A, the data lines DL are divided into first through N-th data line groups DG1, DG2, . . . , DGN each of which includes X data lines. In other words, each of the first through N-th data line groups DG1~DGN include the same number (e.g., X) of data lines. For example, if it is decided there will be five groups of data lines, a first number is associated with the first group of data lines (i.e., the left-most group), a second number is associated with the fifth group of data lines (i.e., the right-most group), and a third number is associated with the second through fourth group of data lines (i.e., the middle groups), and X is three, then the first number is set to three, the second number is set to three, and the third number is set to three. Thus, there would be a first group of three data lines, a fifth group of three data lines, and all the groups in between would also include three data lines.

The first number is changed from X to one of (X+Y) and (X−Y) based on the grouping control signal GCS, where Y is a natural number (step S120). In other words, the data lines DL are re-divided based on a scheme different from that of the first grouping. The grouping of the data lines DL in step S120 may be referred to as a second grouping.

In an exemplary embodiment, when the first number is changed in step S120, the second number is also changed. When the first number and the second number are both changed, the change may occur at the same time (e.g., simultaneously) or at substantially the same time. For example, as described above with reference to FIG. 2, when the first and N-th data line groups are adjacent to the first and second sides of the display panel 100, respectively, the numbers of data lines in the outermost data line groups (e.g., the first and last data line groups) may be changed together.

For example, when the first number is changed from X to (X+Y), the second number is be changed from X to (X−Y). Using the above example of five groups where X is 3, if it is assumed further that Y is 1 and the first number is changed from an X to (X+Y) (i.e., from 3 to 4), and the second number is changed from an X to (X−Y) (i.e., from 3 to 2), then the result would be a first group of 4 data lines, a fifth group of 2 data lines, and 3 data lines for each of the groups in between. As illustrated in FIG. 5B, the data lines DL may be divided into first through N-th data line groups DG1', DG2', . . . , DGN'. The first data line group DG1' that is adjacent to the first side of the display panel 100 includes (X+Y) data lines. The N-th data line group DGN' that is adjacent to the second side of the display panel 100 includes (X−Y) data lines.

For another example, when the first number is changed from X to (X−Y), the second number is changed from X to (X+Y). As illustrated in FIG. 5C, the data lines DL may be divided into first through N-th data line groups DG1", DG2", . . . , DGN". The first data line group DG1" that is adjacent to the first side of the display panel 100 includes (X−Y) data lines. The N-th data line group DGN" that is adjacent to the second side of the display panel 100 includes (X+Y) data lines. Using the above example of five groups where X is 3, if it is assumed further that Y is 1 and the first number is changed from an X to (X−Y) (i.e., from 3 to 2), and the second number is changed from an X to (X+Y) (i.e., from 3 to 4), then the result would be a first group of 2 data lines, a fifth group of 4 data lines, and 3 data lines for each of the groups in between.

In an exemplary embodiment, when the first number and the second number are changed in step S120, the third number is maintained. In other words, the third number is maintained as X, regardless of the change of the first and second numbers.

For example, as illustrated in FIG. 5B, the first data line group DG1' includes (X+Y) data lines, the N-th data line group DGN' includes (X−Y) data lines, and each of data line groups (e.g., DG2') other than the first and N-th data line groups DG1' and DGN' (e.g., the middle groups) include X data lines.

For another example, as illustrated in FIG. 5C, the first data line group DG1" includes (X−Y) data lines, the N-th data line group DGN" includes (X+Y) data lines, and each of data line groups (e.g., DG2") other than the first and N-th data line groups DG1" and DGN" include X data lines.

Although the third number is maintained, positions and data lines of the data line groups (e.g., DG2 in FIG. 5A, DG2' in FIG. 5B and DG2" in FIG. 5C) other than the first and N-th data line groups may be changed depending on the first number and the second number. For example, the second data line group DG2 in FIG. 5A includes (X+1)-th through 2X-th data lines, the second data line group DG2' in FIG. 5B includes (X+Y+1)-th through (2X+Y)-th data lines, and the second data line group DG2" in FIG. 5C include (X−Y+1)-th through (2X−Y)-th data lines. Using the above example of five groups, the second data line group DG2 of FIG. 5A would include $4^{th}$-$6^{th}$ data lines, the second data line group DG' of FIG. 5B would include $5^{th}$-$7^{th}$ data lines, and the second data line group DG" of FIG. 5C would include $3^{rd}$-$5^{th}$ data lines.

Referring to FIGS. 1, 4, 5A, 5B and 5C, in step S200, at a first time, the first data voltages are applied to the first data line group based on the shift clock signal UCK (step S210). At a second time at which one unit interval has elapsed from the first time, second data voltages are applied to a second data line group based on the shift clock signal UCK (step S220). At an N-th time at which (N−1) unit intervals have elapsed from the first time, the N-th data voltages are applied to the N-th data line group based on the shift clock signal UCK (step S230). For example, the first time occurs before the second time, and the second time occurs before the N-th second time.

In an exemplary embodiment, a period of the shift clock signal UCK is the same as or substantially the same as the one unit interval. For example, the first data voltages are output in response to a first pulse (e.g., a first rising edge or a first falling edge) of the shift clock signal UCK, the second data voltages are output in response to a second pulse of the shift clock signal UCK, and the N-th data voltages are output in response to an N-th pulse of the shift clock signal UCK.

Although not illustrated in FIG. 4, data voltages may also be applied to third through (N−1)-th data line groups. For example, at a third time at which two unit intervals have elapsed from the first time (e.g., c one unit interval has elapsed from the second time), third data voltages are applied to the third data line group based on the shift clock signal UCK.

For example, after the first grouping is performed as illustrated in FIG. 5A, data voltages are applied to the first data line group DG1 at time T11, data voltages are applied to the second data line group DG2 at time T12 at which one unit interval 1UI has elapsed from time T11, and data voltages are applied to the N-th data line group DGN at time T1N at which (N−1) unit intervals (N−1)UI are elapsed from time T11 (e.g., CASE1 in FIG. 5A).

For another example, after the second grouping is performed as illustrated in FIG. 5B, data voltages are applied to the first data line group DG1' at time T21, data voltages are applied to the second data line group DG2' at time T22 at which one unit interval 1UI has elapsed from time T21, and data voltages are applied to the N-th data line group DGN' at time T2N at which (N−1) unit intervals (N−1)UI have elapsed from time T21 (e.g., CASE2 in FIG. 5B).

Similarly, after the second grouping is performed as illustrated in FIG. 5C, data voltages are applied to the first data line group DG1" at time T31, data voltages are applied to the second data line group DG2" at time T32 at which one unit interval 1UI has elapsed from time T31, and data voltages are applied to the N-th data line group DGN" at time T3N at which (N−1) unit intervals (N−1)UI have elapsed from time T31 (e.g., CASE3 in FIG. 5C).

Referring to FIGS. 3, 4, 5A, 5B and 5C, in an exemplary embodiment of the inventive concept, the first grouping of step S110 and the second grouping of step S120 are alternately and repeatedly performed for displaying images. For example, the first through N-th data line groups (e.g., DG1~DGN in FIG. 5A) is determined based on the first grouping, and then a first image is displayed during a first duration. The first through N-th data line groups (e.g., DG1'~DGN' in FIG. 5B or DG1"~DGN" in FIG. 5C) is determined based on the second grouping, and then a second image is displayed during a second duration subsequent to the first duration. After the second duration, the first through N-th data line groups is determined again based on the first grouping, and then a third image is displayed during a third duration subsequent to the second duration. After the third duration, the first through N-th data line groups is determined again based on the second grouping, and then a fourth image is displayed during a fourth duration subsequent to the third duration.

In an exemplary embodiment, the first number is changed for each frame duration. In other words, the first grouping and the second grouping may be alternately and repeatedly performed for each frame duration. For example, the first grouping may be performed during a first frame duration so that a first frame image is displayed during the first frame duration, such as CASE1 in FIG. 5A. The second grouping may be performed during a second frame duration subsequent to the first frame duration so that a second frame image is displayed during the second frame duration, such as CASE2 in FIG. 5B or CASE3 in FIG. 5C. The first grouping may be re-performed during a third frame duration subsequent to the second frame duration so that a third frame image is displayed during the third frame duration. The second grouping may be re-performed during a fourth frame duration subsequent to the third frame duration, and a fourth frame image may be displayed during the fourth frame duration. In other words, images may be displayed by alternating CASE1 and CASE2 or by alternating CASE1 and CASE3 in a unit of a frame duration.

In an exemplary embodiment, the first number is changed for each horizontal line duration. In other words, the first grouping and the second grouping are alternately and repeatedly performed for each horizontal line duration. For example, the first grouping may be performed during a first horizontal line duration so that a first horizontal line image is displayed during the first horizontal line duration, such as CASE1 in FIG. 5A. The second grouping may be performed during a second horizontal line duration subsequent to the first horizontal line duration so that a second horizontal line image is displayed during the second horizontal line duration, such as CASE2 in FIG. 5B or CASE3 in FIG. 5C. The first grouping may be re-performed during a third horizontal line duration subsequent to the second horizontal line duration, and a third horizontal line image may be displayed during the third horizontal line duration. The second grouping may be re-performed during a fourth horizontal line duration subsequent to the third horizontal line duration, and a fourth horizontal line image may be displayed during the fourth horizontal line duration. In other words, images may be displayed by alternating CASE1 and CASE2 or by alternating CASE1 and CASE3 in a unit of a horizontal line duration.

In an exemplary embodiment, Y is variable. For example, Y may increase or decrease by a lapse of driving time of the display panel 100. For example, when the images are displayed by alternating CASE1 and CASE2 in a unit of a horizontal line duration and/or in a unit of a frame duration, Y may be set as one at an initial operation time, and Y may be changed from one to two after a predetermined interval has elapsed from the initial operation time.

In a method of operating the display panel according to an exemplary embodiment of the inventive concept, the data lines DL are divided into a plurality of data line groups, and the data voltages are sequentially applied to the data line groups at different times. Thus, a time duration to charge the plurality of pixels in the display panel 100 may be compensated. In addition, the number of data lines in at least one data line group may be changed for each frame duration and/or each horizontal line duration. Accordingly, a horizontal spot line or a vertical spot line on the display panel 100 may be prevented.

Figure 6:
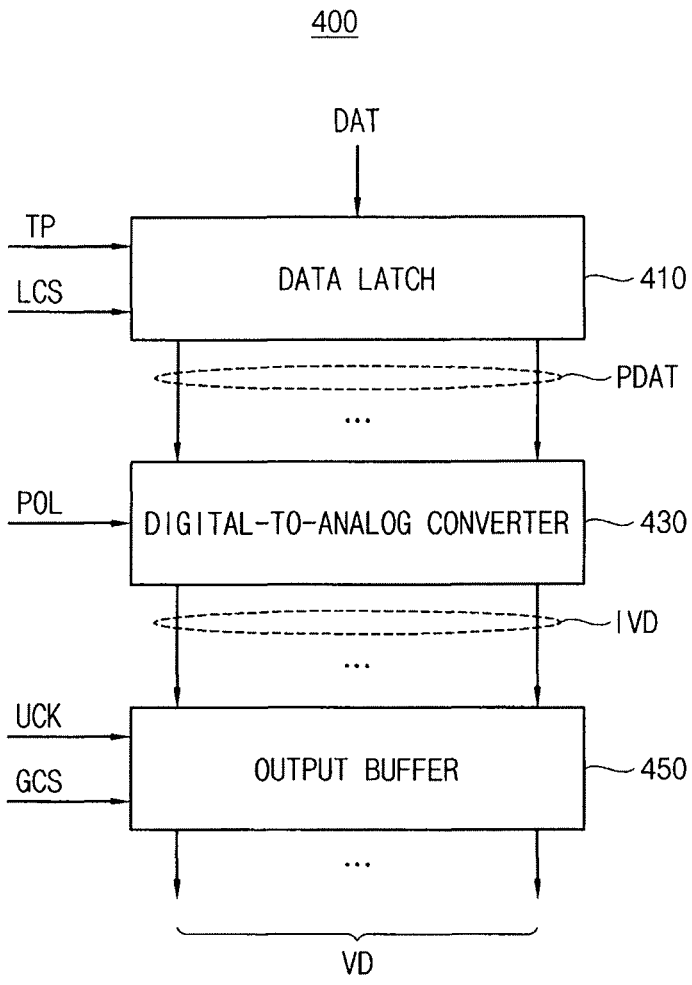
FIG. 6 is a block diagram illustrating a data driver included in the display apparatus according to an exemplary embodiment of the inventive concept.

FIG. 6 is a block diagram illustrating a data driver included in the display apparatus according to an exemplary embodiment of the inventive concept.

Referring to FIGS. 1 and 6, a data driver 400 includes a data latch 410, a digital-to-analog converter 430 and an output buffer 450.

The data latch 410 stores the output image data DAT based on a latch control signal LCS. The output image data DAT may be sequentially stored in the data latch 410 based on the latch control signal LCS.

Although not illustrated in FIG. 6, the data driver 400 may further include a shift register that generates the latch control signal LCS based on a horizontal start signal and a data clock signal.

The data latch 410 may output parallel image data PDAT based on a data load signal TP. The data load signal TP may be included in the second control signal CONT2. The parallel image data PDAT may be output from the data latch 410 based on the data load signal TP. The data within the parallel image data PDAT may be output simultaneously from the data latch 410 or be output substantially simultaneously from the data latch 410.

The digital-to-analog converter 430 may generate internal data voltages IVD based on the parallel image data PDAT and a polarity control signal POL. The polarity control signal POL may be included in the second control signal CONT2. The internal data voltages IVD may include first data voltages and second data voltages. Each first data voltage may have a positive polarity, and each second data voltage may have a negative polarity. The first data voltages (e.g., data voltages with the positive polarity) may have levels higher than that of a common voltage. The second data voltages (e.g., data voltages with the negative polarity) may have levels lower than that of the common voltage.

Although not illustrated in FIG. 6, the digital-to-analog converter 430 may further receive grayscale compensation data to compensate the parallel image data PDAT.

The output buffer 450 may output a plurality of data voltages VD to the plurality of data lines DL based on the shift clock signal UCK, the grouping control signal GCS and the internal data voltages IVD. The data voltages VD may be provided to the display panel 100 through the data lines DL, and the display panel 100 may display images based on the data voltages VD.

The output buffer 450 may be implemented to perform the grouping of the data lines DL and the driving of the data line groups described above with reference to FIGS. 2, 3, 4, 5A, 5B and 5C. For example, the output buffer 450 can output a first set of the data voltages VD to the first group of data lines at a first time, a second set of the data voltages VD to the second group of data lines at a second time after the first time, and output an n-th set of the data voltages VD to the n-th group of data lines at an n-th time after the second time, where the identities and locations of the data lines within the each group may change based on the above-described driving schemes illustrated in FIGS. 5A-5C.

Hereinafter, a method of operating the display panel according to an exemplary embodiment of the inventive concept will be explained in detail using an example where one data line group based on the first grouping includes twelve data lines (e.g., X=12), and where the number of data lines in one data line group is changed by one or two (e.g., Y=1 or 2).

Figure 7:
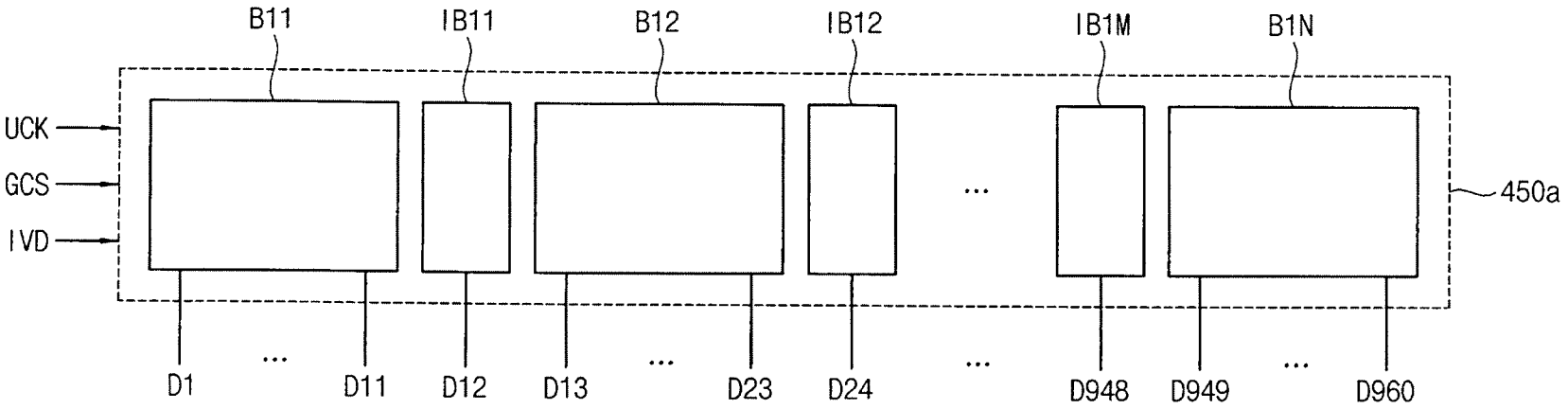
FIG. 7 is a block diagram illustrating an output buffer included in the data driver of FIG. 6 according to an exemplary embodiment of the inventive concept.

FIG. 7 is a block diagram illustrating an output buffer included in the data driver of FIG. 6 according to an exemplary embodiment of the inventive concept.

Referring to FIG. 7, an output buffer 450*a* includes a plurality of fixed buffers B11, B12, . . . , B1N and a plurality of convertible buffers IB11, IB12, . . . , IB1M.

Each of the fixed buffers B11~B1N may be connected to several data lines. For example, the fixed buffer B11 may be connected to first through eleventh data lines D1, . . . , D11. The fixed buffer B12 may be connected to thirteenth through twenty-third data lines D13, . . . , D23. The fixed buffer B1N may be connected to nine-hundred-forty-ninth through nine-hundred-sixtieth data lines D949, . . . , D960. The fixed buffer B1N may be connected to twelve data lines (e.g., X data lines). Each of fixed buffers other than the fixed buffer BIN may be connected to eleven data lines (e.g., (X−1) data lines).

Each of the convertible buffers IB11~IB1M may be disposed between two adjacent fixed buffers, and may be connected to one data line. For example, the convertible buffer IB11 may be disposed between the fixed buffers B11 and B12, and may be connected to a twelfth data line D12. The convertible buffer IB12 may be connected to a twenty-fourth data line D24. The convertible buffer IB1M may be connected to a nine-hundred-forty-eighth data line D948.

Each of the fixed buffers B11~B1N and each of the convertible buffers IB11~IB1M may be included in one of first through N-th buffer groups each of which corresponds to a respective one of the first through N-th data line groups. Each of the fixed buffers B11~B1N may be always included in the same buffer group. For example, the fixed buffer B11 may be always included in the first buffer group, and the fixed buffer B12 may be always included in a second buffer group. Each of the convertible buffers IB11~IB1M may be included in one of two adjacent buffer groups. For example, the convertible buffer IB11 may be included in one of the first and second buffer groups.

Each of the first through N-th buffer groups may output data voltages in response to a respective one of first through N-th pulses of the shift clock signal UCK.

Figure 8A:
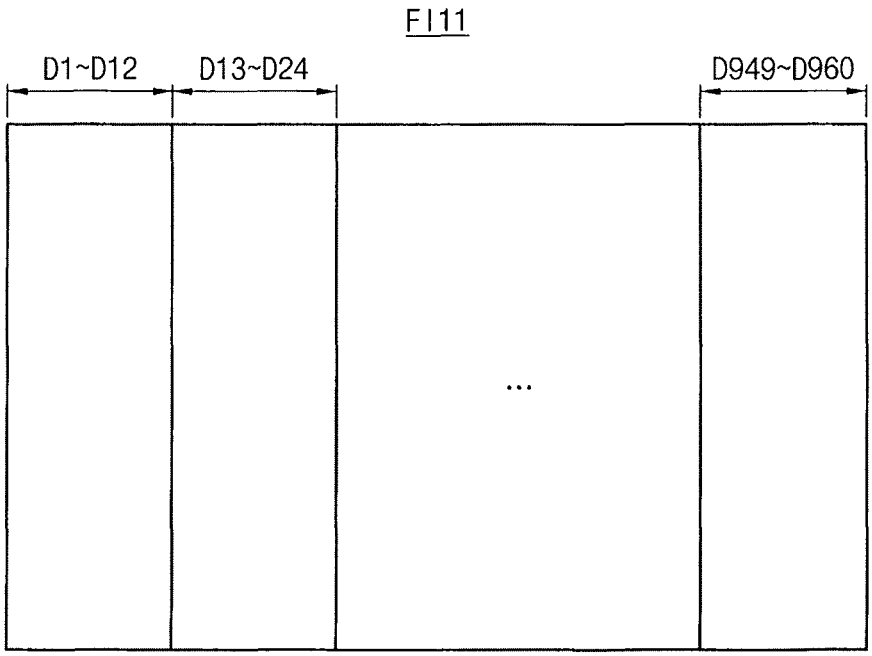
FIGS. 8A, 8B, 9A and 9B are diagrams for describing an operation of the output buffer of FIG. 7 according to an exemplary embodiment of the inventive concept.
Figure 8B:
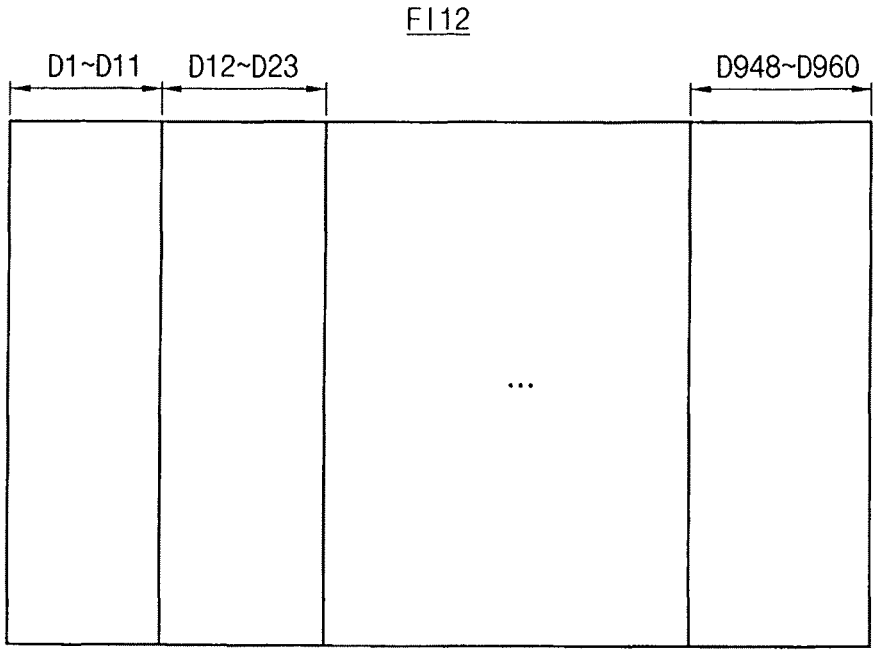
Figure 9A:
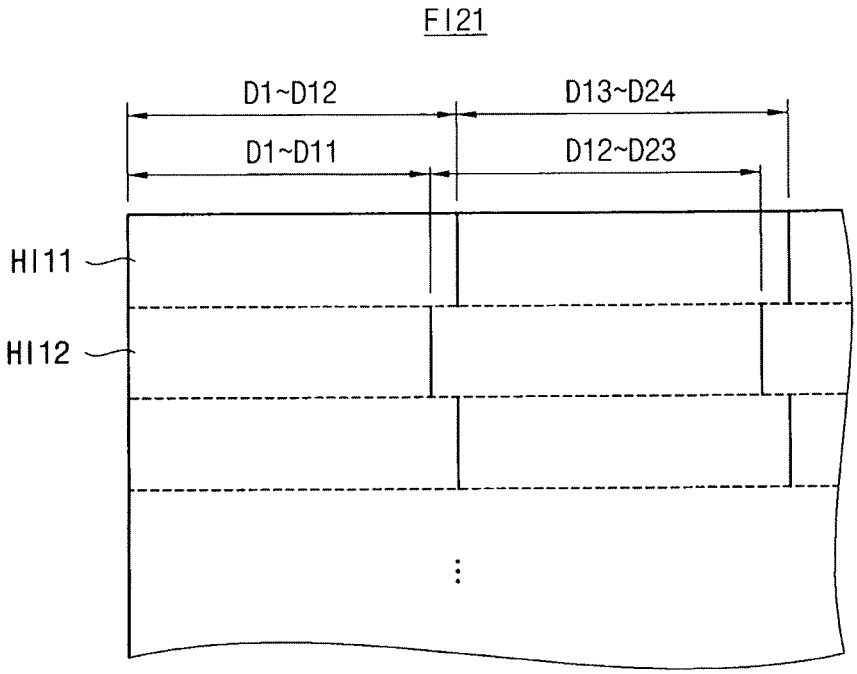
Figure 9B:
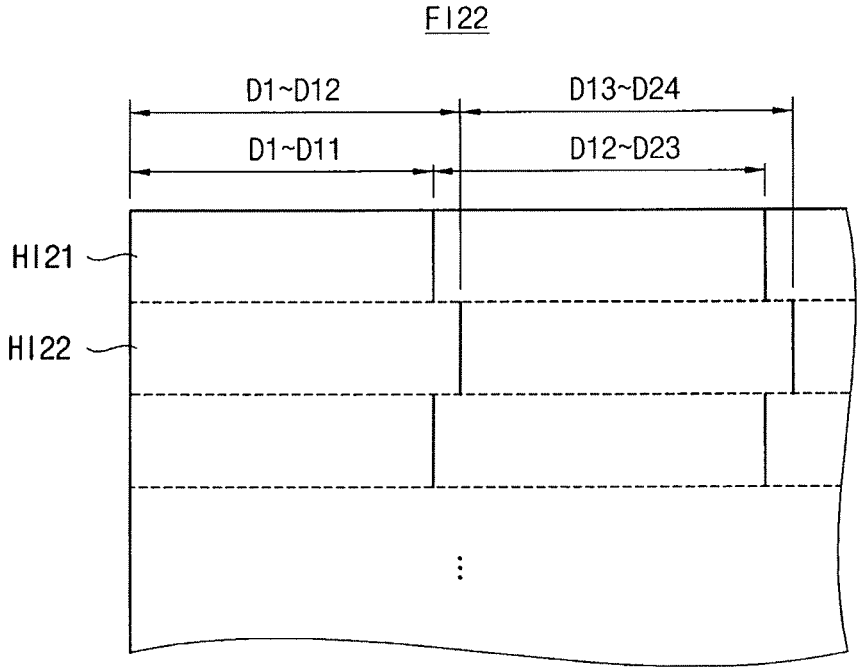

FIGS. 8A, 8B, 9A and 9B are diagrams for describing an operation of the output buffer of FIG. 7. FIGS. 8A and 8B illustrate the whole of frame images. FIGS. 9A and 9B illustrate a portion of frame images.

Referring to FIGS. 7, 8A and 8B, the first number of the data lines in the first data line group may be changed for each frame duration.

In an exemplary embodiment, all of the first number, the second number and the third number are set to twelve (e.g., X) to display a first frame image FI11 of FIG. 8A. The first number may be set as eleven (e.g., (X−1)) to display a second frame image FI12 of FIG. 8B.

For example, the first grouping of step S110 in FIG. 3 is performed during a first frame duration for displaying the first frame image FI11. Based on the first grouping, the data lines D1~D12 are determined as the first data line group, the data lines D13~D24 are determined as the second data line group, and the data lines D949~D960 are determined as the N-th data line group. The buffers B11 and IB11 is included in the first buffer group, the buffers B12 and IB12 are included in the second buffer group, the buffer IB1M is included in an (N−1)-th buffer group, and the buffer B1N is included in the N-th buffer group. In an exemplary embodiment, the buffers that are not in use during a particular application of a corresponding set of data voltages can be turned off to save power. For example, if it is time to apply data voltages to data lines D1~D12, then buffers B11 and IB11 can be activated while the other buffers are deactivated. In an exemplary embodiment, additional switching circuitry (e.g., switches, multiplexes) are used to route the data voltages to the appropriate buffers.

To display a plurality of horizontal line images included in the first frame image FI11, the buffers B11 and IB11 output the data voltages in response to the first pulse of the shift clock signal UCK, the buffers B12 and IB12 output the data voltages in response to the second pulse of the shift clock signal UCK, and the buffer B1N outputs the data voltages in response to the N-th pulse of the shift clock signal UCK. As a result, each of the horizontal line images in the first frame image FI11 may be displayed as CASE1 in FIG. 5A.

In addition, the second grouping of step S120 in FIG. 3 may be performed during a second frame duration, which is subsequent to the first frame duration, for displaying the second frame image FI12. Based on the second grouping, the data lines D1~D11 are determined as the first data line group, the data lines D12~D23 are determined as the second data line group, and the data lines D948~D960 are determined as the N-th data line group. The buffer B11 is included in the first buffer group, the buffers IB11 and B12 are included in the second buffer group, the buffer IB12 is included in a third buffer group, and the buffers IB1M and BIN are included in the N-th buffer group.

To display a plurality of horizontal line images included in the second frame image FI12, the buffer B11 outputs the data voltages in response to the first pulse of the shift clock signal UCK, the buffers IB11 and B12 outputs the data voltages in response to the second pulse of the shift clock signal UCK, and the buffers IB1M and B1N outputs the data voltages in response to the N-th pulse of the shift clock signal UCK. As a result, each of the horizontal line images in the second frame image FI12 may be displayed as CASE3 in FIG. 5C.

In an exemplary embodiment, an order of displaying the frame images FI11 and FI12 may be variable. For example, the first frame image FI11 may be displayed after the second frame image FI12 is displayed.

In an exemplary embodiment, the frame images FI11 and FI12 are alternately displayed in the display panel 100. In other words, images may be displayed by alternating CASE1 and CASE3 in a unit of a frame duration.

Referring to FIGS. 7 and 9A, the first number of the data lines in the first data line group may be changed for each horizontal line duration.

To display a third frame image FI21 during a third frame duration, the first grouping may be performed during a first horizontal line duration of the third frame duration for displaying a first horizontal line image HI11. The data voltages may be sequentially applied to the data line groups that are determined based on the first grouping. As a result, the first horizontal line image HI11 in the third frame image FI21 may be displayed as CASE1 in FIG. 5A. In addition, the second grouping may be performed during a second horizontal line duration of the third frame duration, which is subsequent to the first horizontal line duration of the third frame duration, for displaying a second horizontal line image HI12. The data voltages may be sequentially applied to the data line groups that are determined based on the second grouping. As a result, the second horizontal line image HI12 in the third frame image FI21 may be displayed as CASE3 in FIG. 5C.

In an exemplary embodiment, the horizontal line images HI11 and HI12 are alternately displayed in the third frame image FI21. In other words, images may be displayed by alternating CASE1 and CASE3 in a unit of a horizontal line duration. For example, odd-numbered horizontal line images may be displayed as CASE1, and even-numbered horizontal line images may be displayed as CASE3.

Referring to FIGS. 7, 9A and 9B, the first number of the data lines in the first data line group may be changed for each horizontal line duration and each frame duration.

To display a fourth frame image FI22 during a fourth frame duration subsequent to the third frame duration, the second grouping may be performed during a first horizontal line duration of the fourth frame duration for displaying a first horizontal line image HI21. The data voltages may be sequentially applied to the data line groups that are determined based on the second grouping. As a result, the first horizontal line image HI21 in the fourth frame image FI22 may be displayed as CASE3 in FIG. 5C. In addition, the first grouping may be performed during a second horizontal line duration of the fourth frame duration, which is subsequent to the first horizontal line duration of the fourth frame duration, for displaying a second horizontal line image HI22. The data voltages may be sequentially applied to the data line groups that are determined based on the first grouping. As a result, the second horizontal line image HI22 in the fourth frame image FI22 may be displayed as CASE1 in FIG. 5A.

In an exemplary embodiment, the horizontal line images HI21 and HI22 are alternately displayed in the fourth frame image FI22. In other words, images may be displayed by alternating CASE3 and CASE1 in a unit of a horizontal line duration. For example, odd-numbered horizontal line images may be displayed as CASE3, and even-numbered horizontal line images may be displayed as CASE1.

In an exemplary embodiment, a display order of the frame images FI21 and FI22 may be variable. In an exemplary embodiment, the frame images FI21 and FI22 are alternately displayed in the display panel 100.

In an exemplary embodiment, an order of displaying the frame images FI21 and FI22 is variable. In an exemplary embodiment, the frame images FI21 and FI22 are alternately displayed in the display panel 100.

Figure 10:
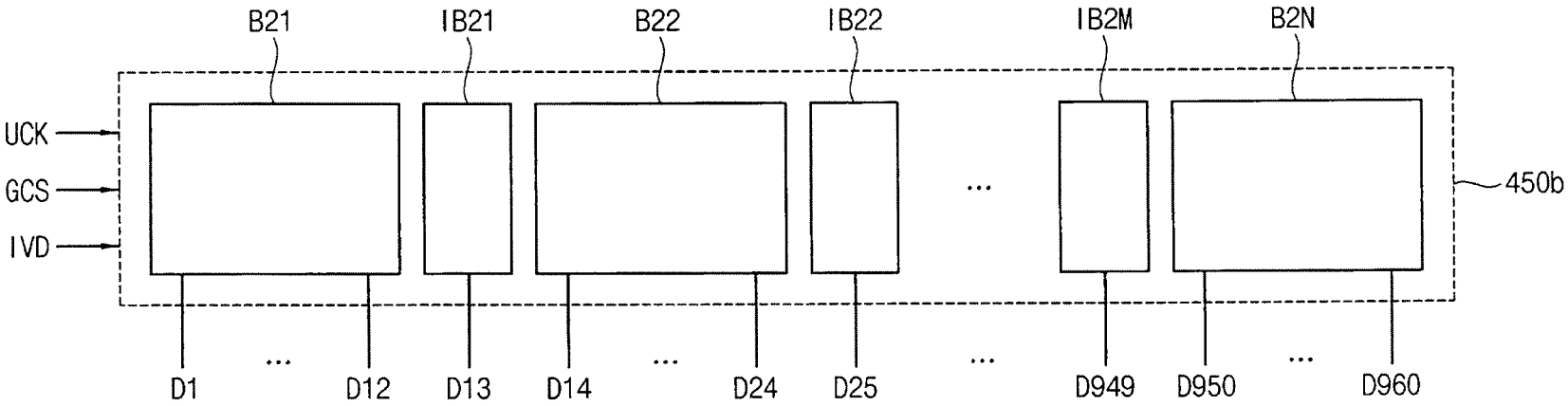
FIG. 10 is a block diagram illustrating an output buffer included in the data driver of FIG. 6 according to an exemplary embodiment of the inventive concept.

FIG. 10 is a block diagram illustrating an output buffer included in the data driver of FIG. 6 according to an exemplary embodiment of the inventive concept.

Referring to FIG. 10, an output buffer 450*b* includes a plurality of fixed buffers B21, B22, . . . , B2N and a plurality of convertible buffers IB21, IB22, . . . , IB2M.

Each of the fixed buffers B21~B2N may be connected to several data lines. For example, the fixed buffer B21 may be connected to first through twelfth data lines D1, . . . , D12. The fixed buffer B22 may be connected to fourteenth through twenty-fourth data lines D14, . . . , D24. The fixed buffer B2N may be connected to nine-hundred-fiftieth through nine-hundred-sixtieth data lines D950, . . . , D960. The fixed buffer B21 may be connected to twelve data lines (e.g., X data lines). Each of fixed buffers other than the fixed buffer B21 is connected to eleven data lines (e.g., (X−1) data lines).

Each of the convertible buffers IB21~IB2M is disposed between two adjacent fixed buffers, and is connected to one data line. For example, the convertible buffer IB21 is disposed between the fixed buffers B21 and B22, and is connected to a thirteenth data line D13. The convertible buffer IB22 is connected to a twenty-fifth data line D25. The convertible buffer IB2M may be connected to a nine-hundred-forty-ninth data line D949.

An operation of the output buffer 450*b* of FIG. 10 may be similar to the operation of the output buffer 450*a* of FIG. 7.

Figure 11A:
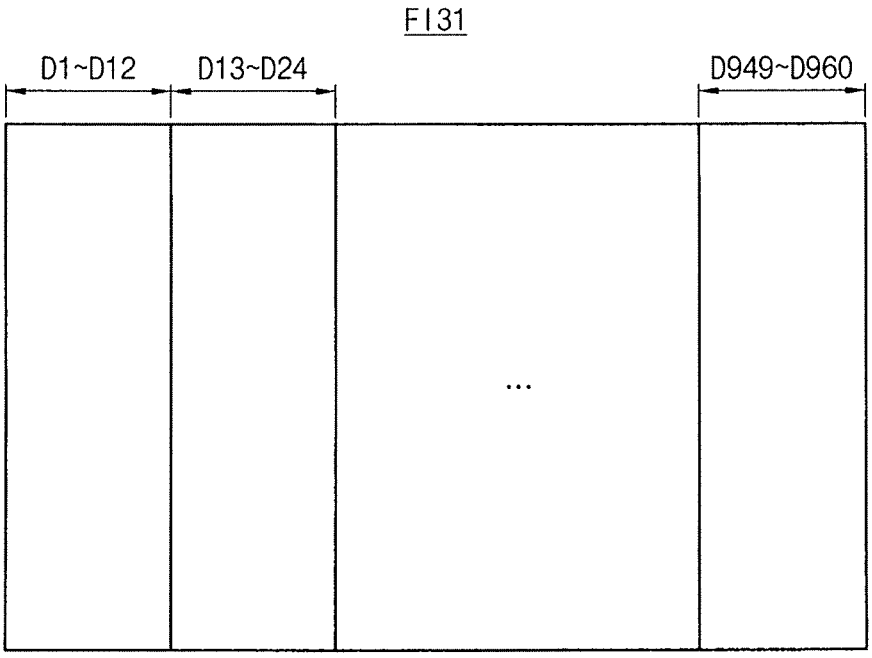
FIGS. 11A and 11B are diagrams for describing an operation of the output buffer of FIG. 10 according to an exemplary embodiment of the inventive concept.
Figure 11B:
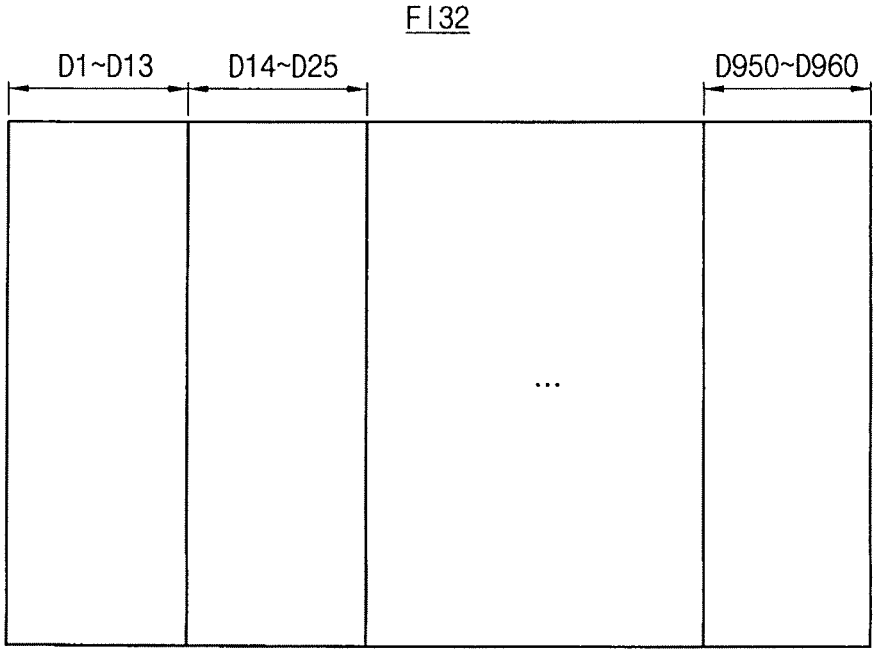

FIGS. 11A and 11B are diagrams for describing an operation of the output buffer of FIG. 10. FIGS. 11A and 11B illustrate the whole of frame images.

Referring to FIGS. 10, 11A and 11B, the first number of the data lines in the first data line group may be changed for each frame duration.

For example, the first grouping may be performed during a fifth frame duration for displaying a fifth frame image FI31. The data voltages may be sequentially applied to the data line groups that are determined based on the first grouping. As a result, each of horizontal line images in the fifth frame image FI31 may be displayed as CASE1 in FIG. 5A. In addition, the second grouping may be performed during a sixth frame duration, which is subsequent to the fifth frame duration, for displaying a sixth frame image FI32. The data voltages may be sequentially applied to the data line groups that are determined based on the second grouping. As a result, each of horizontal line images in the sixth frame image FI32 may be displayed as CASE2 in FIG. 5B.

In an exemplary embodiment, an order of displaying the frame images FI31 and FI32 is variable. In an exemplary embodiment, the frame images FI31 and FI32 are alternately displayed in the display panel 100.

Although not illustrated in FIGS. 11A and 11B, in the operation of the output buffer 450*b* of FIG. 10, the first number of the data lines in the first data line group may be changed for each horizontal line duration (e.g., as illustrated in FIGS. 9A and 9B).

Figure 12:
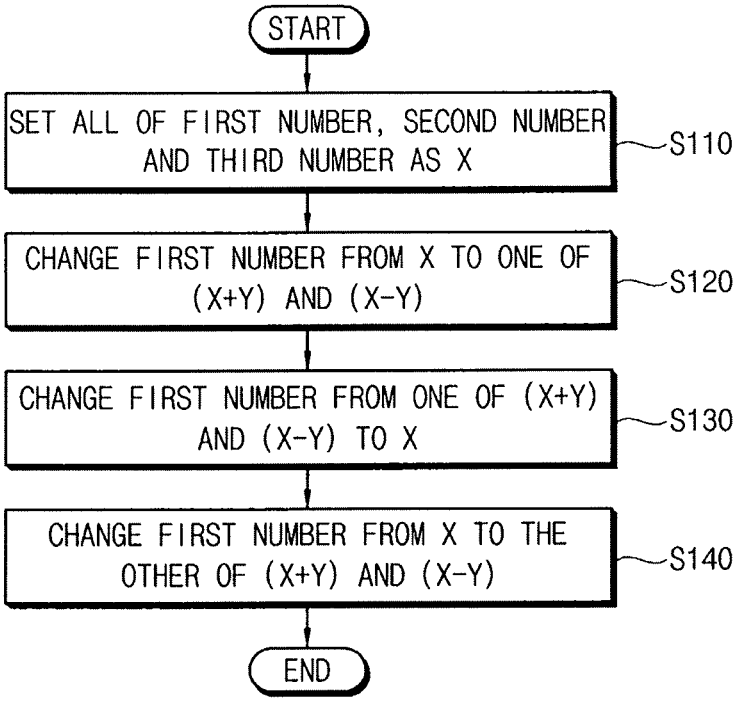
FIG. 12 is a flow chart illustrating an example of step S100 in FIG. 2 according to an exemplary embodiment of the inventive concept.

FIG. 12 is a flow chart illustrating an example of step S100 in FIG. 2 according to an exemplary embodiment of the inventive concept.

Referring to FIGS. 1 and 12, in step S100, all of the first number of the data lines in the first data line group, the second number of the data lines in the N-th data line group, and the third number of the data lines in each of data line groups other than the first and N-th data line groups are set to X based on the grouping control signal GCS (step S110). For example, if X is 12, then the first data line group includes 12 data lines, the last data line group includes 12 data lines, and each of the data line groups in between also include 12 data lines.

The first number is changed from X to a selected one of (X+Y) and (X−Y) based on the grouping control signal GCS (step S120). Using the above example where X is 12, if it is assumed that (X−Y) is selected and Y is 1, then the first number is changed from 12 to 11 and the first group of data lines would then include 11 data lines. Steps S110 and S120 in FIG. 12 may be substantially the same as steps S110 and S120 in FIG. 3, respectively. For example, in an exemplary embodiment, during step S120, the second number may be additionally changed to the other one of (X+Y) and (X−Y) based on the grouping control signal GCS. Using the above example where X is 12 and (X−Y) was selected for the first number, then (X+Y) would be selected for the second number in step S120 so that the last group of data lines would include 13 data lines.

The first number is changed from one of (X+Y) and (X−Y) to X based on the grouping control signal GCS (step S130). In other words, the first grouping is re-performed after the second grouping. For example, using the above example where the first number was changed from 12 to 11 in step S120 would result in the first number being changed back to 12 to result in the first line group including 12 data lines in step S130. For example, in an exemplary embodiment, during step S130, the second number is also set to X based on the grouping control signal CGS.

The first number is changed from X to the other of (X+Y) and (X−Y) based on the grouping control signal GCS (step S140). In other words, the data lines DL may be re-divided based on a scheme different from those of the first and second groupings. The grouping of the data lines DL in step S140 may be referred to as a third grouping. For example, using the above example where the first number was set to (X−Y) in step S120 would result in the first number being set to (X+Y) in step S140 so that the first number is changed from 12 to 13 to result in the first group of data lines including 13 data lines. In an exemplary embodiment, in addition to the first number being set to (X+Y) in step S140, the second number may be set to (X−Y) so that the second number is changed to 11 to result in a group of data lines including 11 data lines.

In an exemplary embodiment, the first grouping of step S110, the second grouping of step S120, the first grouping of step S130 and the third grouping of step S140 are alternately and repeatedly performed for displaying images for each horizontal line duration and/or each frame duration. For example, the images may be displayed by alternating CASE1 in FIG. 5A, CASE2 in FIG. 5B, CASE1 in FIG. 5A and CASE3 in FIG. 5C in a unit of a horizontal line duration and/or a unit of a frame duration. For example, the frame image FI11 of FIG. 8A, the frame image FI12 of FIG. 8B, the frame image FI31 of FIG. 11A and the frame image FI32 of FIG. 11B may be sequentially displayed.

Figure 13:
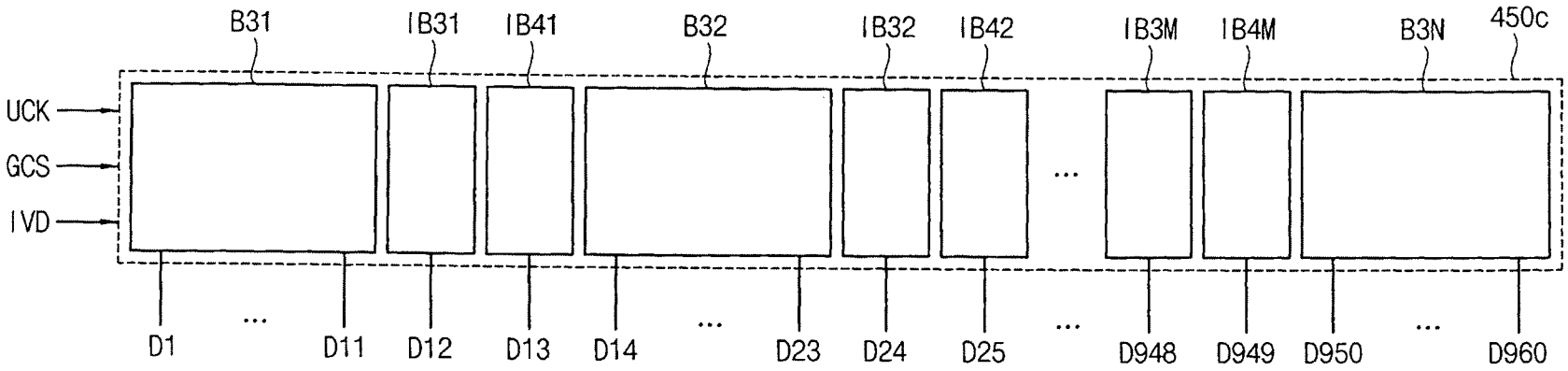
FIGS. 13 and 14 are block diagrams illustrating an output buffer included in the data driver of FIG. 6 according to an exemplary embodiment of the inventive concept.
Figure 14:
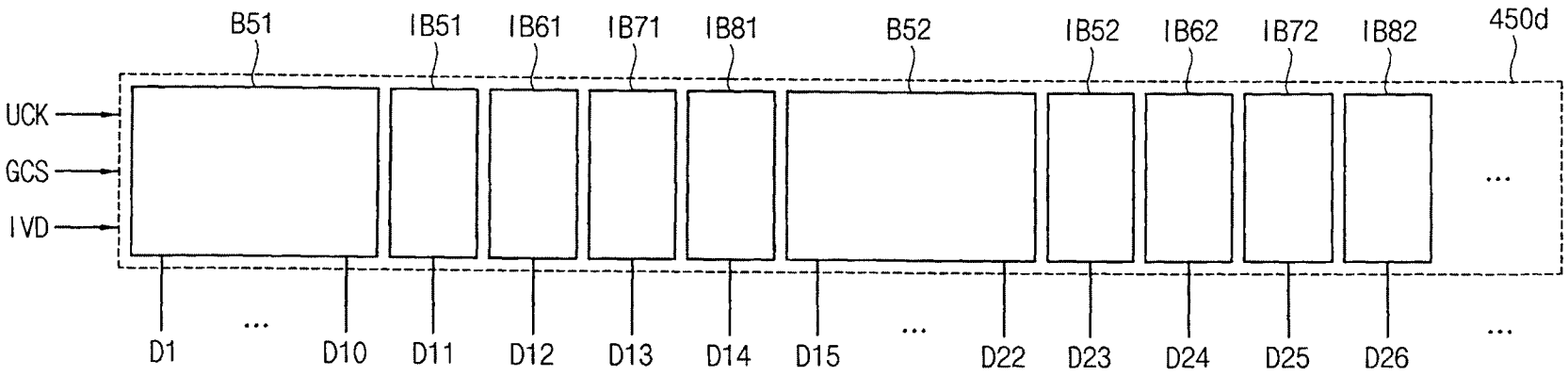

FIGS. 13 and 14 are block diagrams illustrating an output buffer included in the data driver of FIG. 6 according to an exemplary embodiment of the inventive concept.

Referring to FIG. 13, an output buffer 450*c* includes a plurality of fixed buffers B31, B32, . . . , B3N and a plurality of convertible buffers IB31, IB41, IB32, IB42, . . . , IB3M, IB4M.

Each of the fixed buffers B31~B3N may be connected to several data lines. For example, the fixed buffer B31 may be connected to first through eleventh data lines D1, . . . , D11. The fixed buffer B32 may be connected to fourteenth through twenty-third data lines D14, . . . , D23. The fixed buffer B3N may be connected to nine-hundred-fiftieth through nine-hundred-sixtieth data lines D950, . . . , D960. Each of the fixed buffers B31 and B3N may be connected to eleven data lines (e.g., (X−1) data lines). Each of fixed buffers other than the fixed buffers B31 and B3N may be connected to ten data lines (e.g., (X−2) data lines).

Each of the convertible buffers IB31~IB3M and IB41~IB4M are disposed between two adjacent fixed buffers, and are connected to one data line. For example, the convertible buffers IB31 and IB41 may be disposed between the fixed buffers B31 and B32. The convertible buffers IB31 and IB41 may be connected to twelfth and thirteenth data lines D12 and D13, respectively. The convertible buffers IB32 and IB42 may be connected to twenty-fourth and twenty-fifth data lines D24 and D25, respectively. The convertible buffers IB3M and IB4M may be connected to nine-hundred-forty-eighth and nine-hundred-forty-ninth data lines D948 and D949, respectively.

An operation of the output buffer 450*c* of FIG. 13 will be described based on an example where the first number of the data lines in the first data line group is changed for each frame duration.

The first grouping of step S110 or step S130 in FIG. 12 may be performed to display the frame image FI11 of FIG. 8A or the frame image FI31 of FIG. 11A. Based on the first grouping, the data lines D1~D12 are determined as the first data line group, and the buffers B31 and IB31 are included in the first buffer group corresponding to the data lines D1~D12 (e.g., the first data line group). Similarly, the buffers IB41, B32 and IB32 are included in the second buffer group corresponding to the second data line group, and the buffers IB4M and B3N are included in the N-th buffer group corresponding to the N-th data line group. Each of the first through N-th buffer groups based on the first grouping may output the data voltages in response to a respective one of the first through N-th pulses of the shift clock signal UCK.

The second grouping of step S120 in FIG. 12 may be performed to display the frame image FI12 of FIG. 8B. Based on the second grouping, the buffer B31 is included in the first buffer group, the buffers IB31, IB41 and B32 are included in the second buffer group, and the buffers IB3M, IB4M and B3N are included in the N-th buffer group. Each of the first through N-th buffer groups based on the second grouping may output the data voltages in response to the respective one of the first through N-th pulses of the shift clock signal UCK.

The third grouping of step S140 in FIG. 12 may be performed to display the frame image FI32 of FIG. 11B. Based on the third grouping, the buffers B31, IB31 and IB41 are included in the first buffer group, the buffers B32, IB32 and IB42 are included in the second buffer group, and the buffer B3N is included in the N-th buffer group. Each of the first through N-th buffer groups based on the third grouping may output the data voltages in response to the respective one of the first through N-th pulses of the shift clock signal UCK.

In some exemplary embodiments, an order of displaying the frame images FI11, FI12, FI31 and FI32 may be variable. In an exemplary embodiment, the output buffer 450*c* is employed in an example where the first number is changed for each horizontal line duration. In some exemplary embodiments, an operation of the output buffer 450*c* may be substantially the same as the operation of the output buffer 450*a* of FIG. 7 described above with reference to FIGS. 8A, 8B, 9A and 9B, and/or the operation of the output buffer 450*b* of FIG. 10 described above with reference to FIGS. 11A and 11B. In an exemplary embodiment, the output buffer 450*c* is employed in an example where only the frame images FI12 and FI32 are alternately displayed.

Referring to FIG. 14, an output buffer 450*d* includes a plurality of fixed buffers B51 and B52 and a plurality of convertible buffers IB51, IB61, IB71, IB81, IB52, IB62, IB72 and IB82.

Each of the fixed buffers is connected to several data lines. For example, the fixed buffer B51 may be connected to first through tenth data lines D1, . . . , D10. The fixed buffer B52 may be connected to fifteenth through twenty-second data lines D15, . . . , D22. Each of the fixed buffers (e.g., B51) connected to the first and N-th data line groups may be connected to ten data lines (e.g., (X−2) data lines). Each of fixed buffers other than the fixed buffers connected to the first and N-th data line groups may be connected to eight data lines (e.g., (X−4) data lines).

Each of the convertible buffers are disposed between two adjacent fixed buffers, and are connected to one data line. For example, the convertible buffers IB51, IB61, IB71 and IB81 are disposed between the fixed buffers B51 and B52. The convertible buffers IB51, IB61, IB71 and IB81 may be connected to eleventh through fourteenth data lines D11, D12, D13 and D14, respectively. The convertible buffers IB52, IB62, IB72 and IB82 may be connected to twenty-third through twenty-sixth data lines D23, D24, D25 and D26, respectively.

In an exemplary embodiment, the output buffer 450*d* is employed in an example where the first number is changed by more than one (e.g., by two). For example, based on the first grouping, the buffers B51, IB51 and IB61 are included in the first buffer group, and the buffers IB71, IB81, B52, IB52 and IB62 are included in the second buffer group. When the first number is changed to (X−2) (e.g., ten) based on one of the second and third groupings, the buffer B51 is included in the first buffer group, and the buffers IB51, IB61, IB71, IB81 and B52 are included in the second buffer group. When the first number is changed to (X+2) (e.g., fourteen) based on one of the second and third groupings, the buffers B51, IB51, IB61, IB71 and IB81 are included in the first buffer group, and the buffers B52, IB52, IB62, IB72 and IB82 are included in the second buffer group.

FIG. 15 is a table illustrating an example of grouping data lines based on the method of operating the display panel according to exemplary embodiments of the inventive concept.

Referring to FIG. 15, CASEA may correspond to the frame image FI11 of FIG. 8A and the frame image FI31 of FIG. 11A, CASEB may correspond to the frame image FI12 of FIG. 8B, and CASEC may correspond to the frame image FI32 of FIG. 11B. CASED and CASEE may be performed based on the output buffer 450*d* of FIG. 14.

In the method of operating the display panel according to an exemplary embodiment, at least two of various groupings illustrated in FIG. 15 may be alternately and repeatedly performed for displaying images for each horizontal line duration and/or each frame duration. Accordingly, a horizontal spot line or a vertical spot line on the display panel 100 may be prevented.

Although the exemplary embodiments are described based on the examples where the display panel includes a specific number of data lines and the data lines are divided into a specific number of data line groups, the exemplary embodiments may be employed in a display panel that includes any number of data lines or any number of data line groups.

The above described embodiments may be used in a display apparatus and/or a system including the display apparatus, such as a mobile phone, a smart phone, a personal digital assistant (PDA), a portable multimedia player (PMP), a digital camera, a digital television, a set-top box, a music player, a portable game console, a navigation device, a personal computer (PC), a server computer, a workstation, a tablet computer, a laptop computer, a smart card, a printer, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the teachings of the present inventive concept. Accordingly, all such modifications are intended to be included within the scope of the present inventive concept.

What is claimed is:

1. A method of operating a display panel, the method comprising:

dividing a plurality of data lines into a first data line group through an N-th data line group, where N is a natural number equal to or greater than two, each of the first through N-th data line groups including at least two data lines, wherein each data line group initially includes X data lines;

performing a sequential driving of the first through N-th data line groups by applying first data voltages through N-th data voltages to the first through N-th data line groups, respectively at different times during a first duration to display a first image;

changing the first data line group to have one of i) (X+Y) data lines and ii) (X−Y) data lines:

changing the N-th data line group to have the other one of the i) X+Y) data lines and ii) (X−Y) data lines;

performing the sequential driving with respect to the data line groups during a second duration adjacent and after the first duration to display a second image;

changing the first data line group and the N-th data line group to each have the X data lines; and performing the sequential driving with respect to the data line groups during a third duration adjacent and after the second duration to display a third image, where X is a natural number equal to or greater than two and Y is a natural number greater than zero.

2. The method of claim 1, wherein each of the durations are frame durations and each of the images are frame images.

3. The method of claim 1, wherein each of the durations are horizontal line durations.

4. The method of claim 1, wherein the sequential driving of the original first through N-th data line groups comprises:

applying the first data voltages to the first data line group at a first time;

applying the second data voltages to the second data line group at a second time at which one unit interval has elapsed from the first time; and applying the N-th data voltages to the N-th data line group at an N-th time at which (N−1) unit intervals has elapsed from the first time.

5. The method of claim 1, where the first duration, the second duration, and the third duration each have a same length.

6. A display apparatus comprising:

a display panel including a plurality of data lines; and a data driver configured to, divide the plurality of data lines into a first data line group through an N-th data line group, where N is a natural number equal to or greater than two, each of the first through N-th data line groups including at least two data lines, where each data line group initially includes X data lines, configured to generate first data voltages through N-th data voltages based on output image data, and configured to perform a sequential driving of the first through N-th data line groups by applying the first data voltages through the N-th data voltages to the first through N-th data line groups, respectively at different times during a first duration to display a first image, wherein the data driver is configured to change the first data line group to have one of i) (X+Y) data lines and ii) (X−Y) data lines, change the N-th data line group to have the other one of the i) (X+Y) data lines and ii) (X−Y) data lines, and perform the sequential driving with respect to the data line groups during a second duration adjacent and after the first duration to display a second image, wherein the data driver is configured to change the first data line group and the N-th data line group to each have the X data lines and perform the sequential driving with respect to the data line groups during a third duration adjacent and after the second duration to display a third image, where X is a natural number equal to or greater than two and Y is a natural number greater than zero.

7. The display apparatus of claim 6, wherein each of the durations are frame durations and each of the images are frame images.

8. The display apparatus of claim 7, wherein when Y is one, the data driver comprises:

a first buffer connected to a first data line through an X-th data line; and a second buffer connected to an (X+1)-th data line.

9. The display apparatus of claim 7, wherein when Y is one, the data driver comprises:

a first buffer connected to a first data line through an (X−1)-th data line;

a second buffer connected to an X-th data line; and a third buffer connected to an (X+1)-th data line.

10. The display apparatus of claim 6, wherein each of the durations are horizontal line durations.

11. The display apparatus of claim 6, wherein the data driver comprises:

a plurality of first buffers configured to output X-Y data voltages;

a plurality of second buffers each configured to output a single data voltage; and a third buffer configured to output X data voltages.

12. The display apparatus of claim 6, wherein the data driver comprises:

a first buffer configured to output X data voltages;

a plurality of second buffers each configured to output a single data voltage; and a plurality of third buffers configured to output X−Y data voltages.

13. The display apparatus of claim 6, where the first duration, the second duration, and the third duration each have a same length.

* * * * *